United States Patent [19]

Mine

[11] Patent Number: 4,899,816

[45] Date of Patent: Feb. 13, 1990

[54] APPARATUS FOR GUIDING WIRELINE

[76] Inventor: Paul Mine, 113 Tyrona St., Lafayette, La. 70507

[21] Appl. No.: 301,142

[22] Filed: Jan. 24, 1989

[51] Int. Cl.[4] ..... E21B 33/072; E21B 33/08; E21B 19/00; E21B 23/00

[52] U.S. Cl. ..... 166/85; 166/84; 166/385

[58] Field of Search ..... 166/84, 85, 77, 67, 166/385, 98, 99; 242/157 R; 254/336, 415

[56] References Cited

U.S. PATENT DOCUMENTS

| | | | |
|---|---|---|---|
| 3,762,725 | 10/1973 | Taylor | 166/84 X |
| 3,804,168 | 4/1974 | Marshall et al. | 166/250 |
| 3,924,686 | 12/1975 | Arnold | 166/85 X |
| 4,090,573 | 5/1978 | Rankin | 166/84 X |
| 4,423,775 | 1/1984 | Wilson | 166/84 |
| 4,469,171 | 9/1984 | Mine | 166/85 |
| 4,577,687 | 3/1986 | Lanmon, II | 166/385 |

*Primary Examiner*—Stephen J. Novosad
*Attorney, Agent, or Firm*—Pravel, Gambrell, Hewitt, Kimball & Krieger

[57] ABSTRACT

An assembly for feeding wireline down the drill pipe, the assembly including a sub body portion having a lower pin portion mounted onto the upper threaded box portion of the upper end of the drill string. The pin portion further includes a member fixed within the bore of the sub, the member including a lower most threaded portion for accommodating the male end of an overshot tool. The member further includes a bore therethrough, which would be coaxially aligned with the bore in the overshot for accommodating the wireline therethrough. On the upper body portion of the sub, there is further provided a pack off means. The wireline assembly further includes a first principle arm member, the lower end of which is secured to the outer wall of the body portion of the assembly, and extending at substantially a 45° angle therefrom. At the second upper end of the principle arm member, there is included a first pulley wheel rotatable secured thereto. There is further included a secondary arm connected to and extending from the principle arm member in a perpendicular fashion, the second arm member likewise including a second pulley wheel at the furthest end therefrom, the second arm member positioned at a point on the principal arm member, so that the pulley wheel at the distal end thereof allows the wireline to be fed around the wheel and dropped vertically directly in alignment with the bore in the body assembly of the wireline retrieval tool.

8 Claims, 3 Drawing Sheets

APPARATUS FOR GUIDING WIRELINE

BACKGROUND OF THE INVENTION

1. Field of the Invention

The present invention relates to wirelines inserted down a string of drill pipe. More particularly, the present invention relates to an apparatus for guiding wireline within the derrick of an oil rig, during wireline operations, which can be used with a top drive system, and further includes an upper packer portion allowing packing off of the wireline in the event of a blow out, and for accommodating an overshot for latching onto a wireline tool retrieved from down hole.

2. General Background

In an oil rig operation, it is often necessary that wireline operations be conducted to undertake certain tasks down hole during drilling. In such operations, a wireline unit is disposed adjacent to the rig floor which would drive a steel cable, or wireline, around a pulley wheel mounted at the top of the oil derrick, with the wireline traveling downwardly through the oil derrick towards the rig floor, and ultimately through the pack off assembly which is connected to the bottom of the circulating head which is made into the bottom end of the drill pipe. The wireline is utilized to control the drill pipe for directional drilling, for example with the the use of a bent sub, the bent sub having a drilling bit mounted to its outer end for drilling. The wireline is often used for other tasks such as surveying downhole, or the like. Often times a wireline utilizes a tool at the end in order to retrieve items which have been lost downhole so that drilling may be resumed after the items are retrieved.

Often times during wireline operations, the wireline, particularly in use with a top drive system, may cause damage to the top drive system as the wire is run through the assembly from the pulley, in order to feed the wireline down the hole. In other types of operations, even when a top drive assembly system is not utilized, the wireline being fed straight down the hole may necessarily cause fraying or even severing of the wireline due to friction or the like on the bell portion of the assembly.

The present inventor is the named patentee in U.S. Pat. No. 4,469,171 entitled "Wireline Guiding Apparatus", which was issued on Sept. 4, 1984. This assembly, included an elongated stationary arm having parallel trusses, attached at a 45° angle to a collar in a pack off assembly and extending upwardly and outwardly, an elongated swivel arm, swivelly attached at its lower end to the uppermost portion of the stationary arm, and extending upwardly and inwardly at about 45° angle. There was included a first pulley wheel mounted between trusses and support by an upper portion of the swivel arm. The pulley receiving the wireline and guided it vertically downward into the pack off assembly. There was further included a bumper connected to the upper portion of the swivel arm for preventing any contact between the traveling block and the wireline. Further, there were a plurality of support plates mounted between the truss at a 45° angle in relation to the truss. A third movable arm having two parallel trusses, and having a second pulley wheel rotatable mounted between the truss for receiving and guiding the wire line, the third arm further having a plurality of reinforcement plates attached between the trusses, and provided with a sleeve to cover a diagonal opening made in one of the third arms. This combination allowed the feeding of a wireline at a position not in aligned with the drill pipe, and enabling it to angle toward the hole, around the second lower pulley wheel, which would enable it to be fed directly into the pipe. This angling of the wireline down into the hole via the apparatus as disclosed in the '171 patent, avoided any contact with the assembly above the drill pipe into which the wireline was being fed.

However, of all the shortcomings of the invention as disclosed and claimed in the '171 patent, was the fact that the wireline that was being fed through the plate sub mounted to the upper portion of the drill pipe allowed the drill pipe to be open to atmosphere, and should a blow out occur, the drill pipe was not secure since the wireline apparatus was in place. Secondly, the bumper on the lower portion of the assembly, although providing a means to prevent the damage to the wireline assembly that was connected to the drill pipe, when a tool was retrieved downhole, did not eliminate the problem of the tool making contact with the assembly, and perhaps severing the line which would in effect cause the tool to be dropped down into the hole which has to be then retrieved.

SUMMARY OF THE PRESENT INVENTION

The apparatus and system of the present invention solves the shortcomings in the art in a simple and straight forward manner. What is provided is an assembly for feeding wireline down the drill pipe, the assembly including a sub body portion having a lower pin portion mounted onto the upper threaded female portion of the upper end of the drill string. The pin portion further includes a member fixed within the bore of the sub, the member including a lower most threaded portion for accommodating the male end of an overshot tool such as a Custer overshot, known in the industry. The member further includes a bore therethrough, which would be coaxially aligned with the bore in the overshot for accommodating the wireline therethrough. On the upper body portion of the sub, there is further provided a pack off means which includes a substantially cylindrical body portion having a bore coaxially aligned with the bore in the sub, the assembly including upper and lower brass portions positioned within the bore of the assembly, with a pack off rubber intermediate the upper and lower brass portions, so that as a locking nut is tightened onto the assembly, the rubbers would compress inwardly to pack off the bore thorough which the wireline is fed therethrough. The wireline assembly further includes a first principal arm member, the lower end of which is secured to the outer wall of the body portion of the assembly, and extending at a substantially a 45° angle therefrom. At the second upper end of the principal arm member, there is included a first pulley wheel rotatable secured thereto. There is further included a secondary arm connected to and extending from the principal arm member in a perpendicular fashion, the second arm member likewise including a second pulley wheel at the furthest end therefrom, the second arm member positioned at a point on the principal arm member, so that the pulley wheel at the distal end thereof allows the wireline to be fed around the wheel and dropped vertically directly in alignment with the bore in the body assembly of the wireline retrieval tool.

Therefore, it is a principal object of the present invention to provide a wireline retrieval tool mountable on the upper end of a drill string, for allowing the feeding of the wireline into the drill string without the wireline having to pass through an upper top drive system on an oil derrick;

It is a further object of the present invention to provide a wireline assembly having the ability to pack off the drill string in the event of a blow out; and It is sill a further object of the present invention to provide a wireline assembly attachable to the upper end of a drill string, for accommodating an over shot tool for securing tools retrieved downhole through the use of a wireline.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
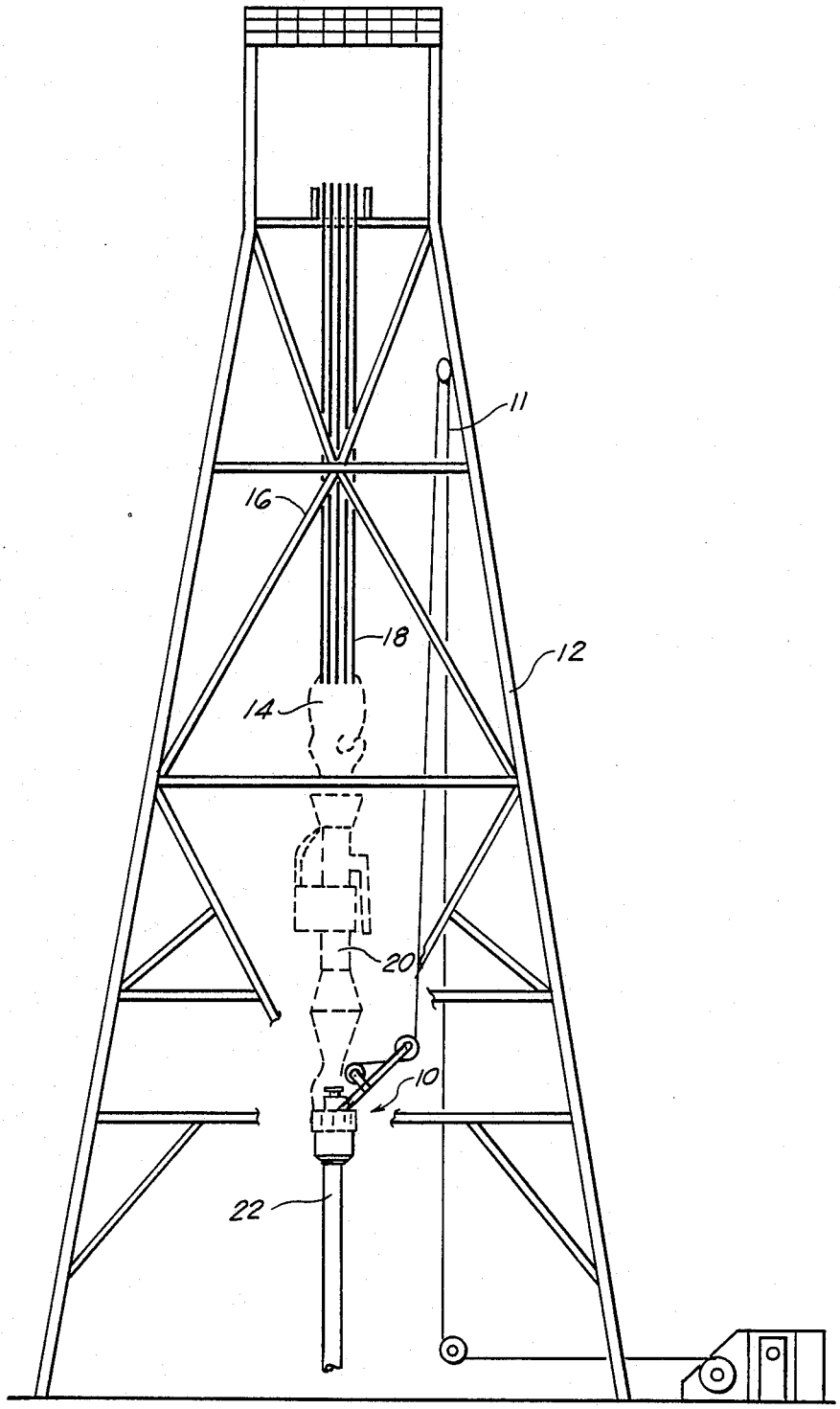
FIG. 1 is an overall view of a derrick rig accommodating the apparatus of the present invention.

The wireline assembly of the present invention is illustrated by the numeral 10 in FIGS. 1 through 4. As illustrated, wireline assembly would be utilized in the event a wireline 11, as illustrated in the Figures, would be utilized to be fed down the drill string, for various tasks with a tool secured to the end of the wireline that is lowered downhole. As illustrated, assembly 10 would also be utilized on a derrick 12 whereby a block 14 is suspended from the upper portion 15 of the oil derrick 12, via cables 18, and is supporting a top drive system 20, in undertaking various operations of the oil rig. The improved assembly of the present invention would be mounted below the top drive system 20, and would allow the introduction of the wireline into the drill pipe 22, without the wireline having to pass through the block 14 or top drive system 20, to be utilized.

Figure 2:
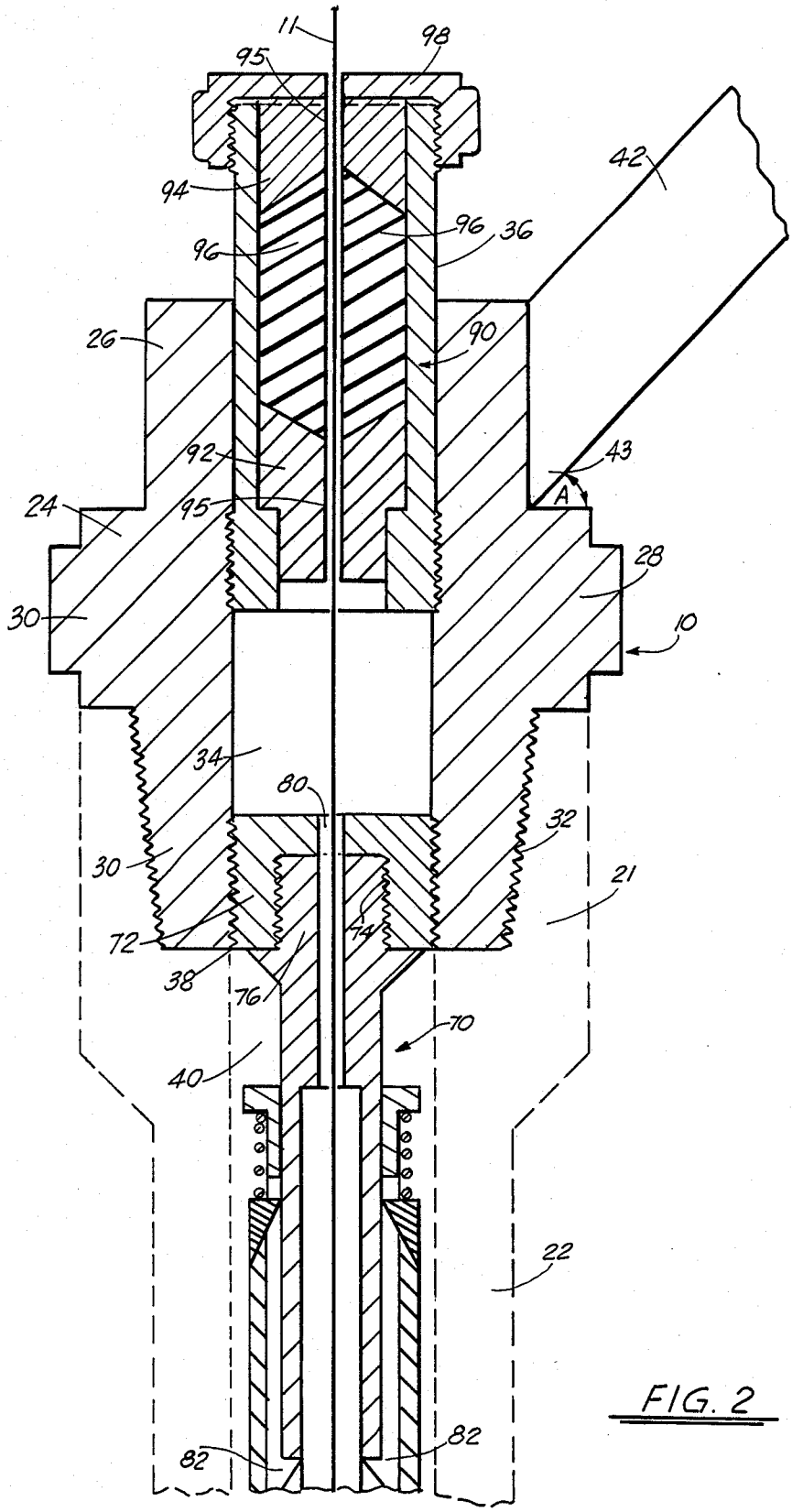
FIG. 2 is a cross-sectional view illustrating the preferred embodiment of the apparatus of the present invention.
Figure 4:
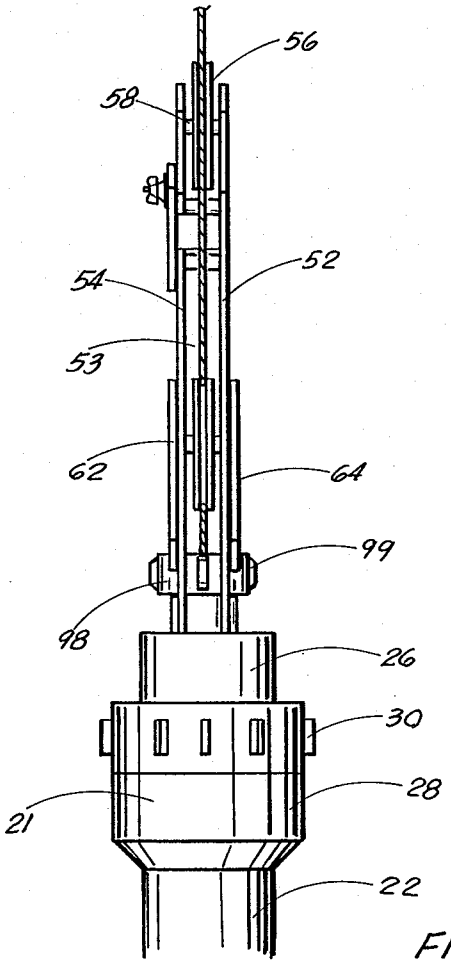
FIGS. 3 and 4 are side and front views respectively of the preferred embodiment of the apparatus of the present invention.

As illustrated in FIG. 2, assembly 10 would include a sub assembly 24, the sub assembly having an annular upper body portion 26, with a thickened exterior central collar portion 28, the thickened collar portion 28 having a lower pin portion 30, having a series of threads 32 for threadably engaging the box portion 34 of a section of drill pipe 22 extending out of the hole. Collar portion 28 would further include a plurality of raised members 30, substantially equally spaced along its circumferential wall, for allowing the assembly 10 to be threadably engaged onto the section of drill pipe manually tightened thereon. As further illustrated, assembly 10, would further include a bore 34, extending therethrough, from its upper most end 36 to its lower most end 38, the bore 34, being of substantially similar and equal diameter of the bore 40 of the drill pipe that it is inter-threaded thereon.

Prior to a discussion of the internal operations of the sub assembly 10, reference is made to the outer portion of the body assembly which incorporates a means for feeding the wireline 11 down through the bore 34 of the sub assembly 10, so that the wireline 11 does not have to run through the top drive system 14 or the like. This means further includes a first principal arm member 42, secured at its lower end 43 through welding or the like to the outer wall 44 of the body portion 26 of assembly 10. Principal arm member 42, would extend substantially at a 45° . A angle from the vertical, outward sufficient distance so that the horizontal distance between the upper end of the arm 50 and the vertical line of the mounted assembly 10, is greater than the width of the top drive system 20 or block 14 illustrated in FIG. 1, in order to be fed around those items.

Figure 3:
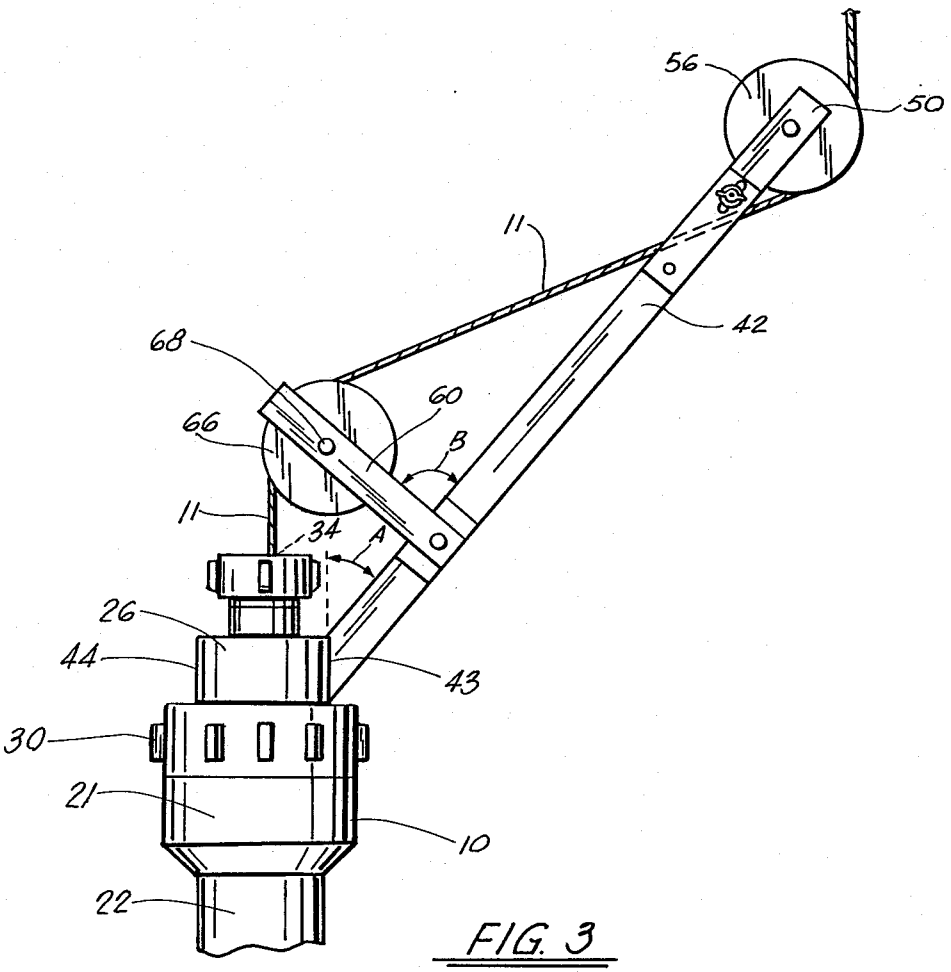

Reference is made to FIG. 3, which is a side view of principal arm 42, which for the most part would include a pair of parallel truss members 52 and 54, secured to one another, with a space 53 therebetween, for accommodating a pulley wheel 56, freely mounted to an axle 58, across the pair of truss members 52 and 54, for allowing wireline 11 to be fed through the "V" in pulley wheel 56, across the space 53 between the truss members 52 and 54, during operation. Further there is included a secondary arm member 60, likewise comprised of a pair of truss members 62 and 64, secured to and extending perpendicular to the principal arm member 42. Arm 60 is positioned a distance up the length of the arm member 42, so that a second pulley wheel 66, likewise mounted via an axle intermediate truss members 62 and 64, freely rotates therebetween, and allows the wireline 11 to be fed via the second pulley wheel 66, and to extend down vertically therefrom. Therefore, so that as the wire 11 is extended vertically downward, it would be directly and coaxially aligned with the bore 34 in the sub assembly 10, to be fed through the bore of the sub assembly 10 down hole.

For the most part, second arm member 60, would be secured to principal arm member 42, via bolting or the like, and would not be adjustable in any manner. Likewise, principal arm member 42, as was stated earlier, would be secured to the wall of the assembly 10, via welding or the like. Again, it is noted that the combination of the pulley wheels 56 and 66, are such that pulley wheel 56 is secured a distance from the vertical path of the wireline 11, to accommodate the top drive system 20 and the block 14 which would be directly above the sub assembly 10, and the second pulley wheel 66 would be so positioned so as to enable the wireline 11 to be fed directly vertically into the bore 34 of the sub assembly 10, and downhole.

Turning now to the combination of the assembly sub 10 (FIG. 2), as was stated earlier, which is threadably engaged to the upper box portion of the upper end of a section of drill pipe 22. The lower end 38 of the assembly is threadably engaged into the box end 21 of a section of drill pipe 22 and would be utilized to accommodate an overshot tool 70, of the type commonly known in the industry, in the following manner.

What would be provided is an annular plug member 72, having an outer diameter substantially equal to the inner diameter of the bore 34, through the lower pin portion of the assembly. Plug member 72 would further include a counter bore 74 threaded in its interior to threadably accommodate the upper end 76 of the overshot 70, as illustrated in FIG. 2. Plug member 72, would be secured to the wall of the bore 34 of the pin portion via spot welding, threading, or the like, and would further include a bore 80 through its central body portion, for accommodating the wireline 11 fed therethrough, the bore being substantially ⅜ inches in diameter. Therefore, an overshot tool 70 could be threadably engaged into the counterbore portion 74 of the plug 72, and would extend down into the bore 40 of the section of drill pipe 22 for latching via latches 82 on to any tool which would be retrieved from downhole during use of the assembly.

Turning now to the upper portion of the assembly 10, there would be further included a pack off means 90, secured within the upper portion of bore 34 of the assembly, pack off means 90 including a bottom packing brass member 92, a top packing brass member 94, with packing rubbers 96 intermediate the upper and lower packing brass members 92 and 94. Each of the members 92, 94, and 96 would include a central continuous bore, substantially ⅜ inch diameter therethrough, again for accommodating the wireline 11 being fed through the top of the assembly into the drill pipe secured thereto. The pack off assembly 90 would further include a locking nut 98, likewise having a bore 95 therethrough for allowing the movement of the wireline 11, so that in the event a pack off must occur, the locking nut 98 being tightened onto the upper portion of the assembly, would force the brass members 92, 94 to put pressure on the rubbers 96 which would in turn squeeze the wireline 11 extending therethrough, and securely pack off any flow of materials or the like coming up through the drill pipe 22 onto the rig floor.

Therefore, the apparatus of the present invention, in addition to the ability to feed a wireline into the drill string from a position off center of the vertical drill string, would likewise provide for a means for packing off the drill string upon which the assembly is in position, in order to prevent a blowout from occurring, and likewise have the ability to latch onto a tool that has been retrieved from downhole as the tool makes contact with the overshot assembly threadably engaged to the lower end of the wireline assembly.

Therefore, in the system of the present invention, as utilizing the apparatus as disclosed therein, one is able to feed a wireline around a first upper pulley wheel positioned off center from the vertical path of the wireline, around a second lower pulley, but as the wireline is fed around the second pulley, its vertical decent would be in coaxially alignment with the borehole of the assembly. Futhermore, the wireline would be fed through the reduced bore of the pack off assembly which is secured to the upper portion of a sub member, through the bore of the sub member, and likewise through the bore of an overshot to be fixedly secure to the lower end of the sub assembly and downward into the bore of the drill string. Therefore, as the wireline is fed down the drill string, in order to accomplish its task, it is able to be lowered in the drill string in such a manner so as to avoid having to be fed through any upper drive system positioned above the rig floor, and should a blow out occur, to be packed off and secure any pressure within the drill string and maintain it downhole. In the event a tool is retrieved from downhole, the wireline assembly would have the ability to latch onto the tool as the tool is retrieved so that the tool would not be lost should the wireline be severed as it makes contact with the wireline assembly mounted onto the drill string.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for guiding a wireline down a hole, the apparatus comprising:

(a) a body portion secured to the upper end of a section of a drill pipe extending out of the hole, the body portion having a bore therethrough;

(b) pack off means positioned on the upper end of the assembly of the body portion, having a bore in coaxial alignment with the bore of the body portion, for sealing off the bore of the body portion;

(c) an overshot portion, secured to the lower end of the body portion, for latching onto a tool which is retrieved from downhole; and (d) means positioned upon and secured to the body portion, for feeding a wireline into the body portion, from a point off of vertical center of the body portion, to be fed directly into the bore of the body portion.

2. The apparatus in claim 1, wherein the pack off means further includes upper and lower metallic portions, having a rubber portion therebetween, for compressing around the wireline when packing off is necessary.

3. The apparatus in claim 1, wherein the pack off means further includes a cap portion threadably securable to the pack off means, so that tightening of the cap portion compresses the rubber within the pack off means for closing around the wireline fed therethrough.

4. The apparatus in claim 1, wherein the overshot portion, further includes latching means for latching onto the tool which is retrieved from down hole when the tool makes contact with the latching means.

5. The apparatus in claim 1, wherein the means positioned and secured to the body portion for allowing a wireline to be fed to the body portion, further comprises:

(a) a first principle arm member secured to and angling from the body portion at substantially 45° angle;

(b) a second arm member secured to and extending perpendicular from a point along the length of the first arm member;

(c) a first pulley wheel rotatably secured to a distal end of the first principle arm member;

(d) a second pulley wheel rotatably secured to the distal end of the second arm member;

(e) means for providing that a wireline fed through the first and second pulley wheels will extend downwardly in a vertical fashion directly in line with the bore of the body portion as the wireline is fed therethrough.

6. An apparatus for guiding a wireline down a length of drill pipe, the apparatus comprising:

(a) a substantially annular body portion threadably secured to the upper end of a section of the drill pipe extending from the hole, the body portion having a continuous bore therethrough in which a wireline is guided;

(b) a pack off assembly threadably positioned on the upper end of the body portion, the pack off assembly including a compressible member, having a bore in coxially alignment with the bore of the body portion, for compressing the wireline and sealing off the bore of the body portion, when the compressible means is compressed to a certain degree;

(c) an overshot portion, threadably secured to the lower end of the body portion, and extending into the upper section of drill pipe, the overshot portion including latching means for latching onto a tool which is retrieved from downhole at the end of the wireline; and (d) at least one arm member positioned and secured to the outer wall of the body portion, the arm member further including a pulley wheel rotatably attached at its first end, for feeding wireline through the arm member, so that the wireline may extend into the borehole from a direct vertical point above the borehole, but may be fed from a point off center of the borehole in order to avoid any contact with machinery or contact with items positioned above the apparatus.

7. An apparatus for guiding a wireline down a length of drill pipe, the apparatus comprising:

(a) a substantially annular body portion threadably secured to the upper end of a section of the drill pipe extending from the hole, the body portion having a continuous bore therethrough in which a wireline is guided;

(b) a pack off assembly threadably positioned on the upper end of the body portion, the pack off assembly including a compressible member, having a bore in coxially alignment with the bore of the body portion, for compressing the wireline and sealing off the bore of the body portion, when the compressible means is compressed to a certain degree;

(c) first and second arm members extending from the outer body portion, each of the arm members having a pulley wheel freely rotatably mounted at their distal end thereof, so that a wireline may be fed into the apparatus from a point that is not directly above the bore of the body portion, until after it has been threaded through the pulley wheels.

8. The apparatus in claim 7, further including an overshot portion, the first and second arm members extending from the outer body portion, each of the arm members having a pulley wheel freely rotatably mounted at their distal end thereof, so that a wireline may be fed into the apparatus from a point that is not directly above the bore of the body portion, until after it has been threaded through the pulley wheels.

* * * * *